US009616689B2

(12) United States Patent
La Vos et al.

(10) Patent No.: US 9,616,689 B2
(45) Date of Patent: Apr. 11, 2017

(54) TRANSPORT MECHANISM AND METHOD FOR TRANSPORTING A PRINT MEDIUM IN A PRINTING SYSTEM

(71) Applicant: OCÉ-TECHNOLOGIES B.V., Venlo (NL)

(72) Inventors: Peter G. La Vos, Venlo (NL); Albert M. Van Beek, Venlo (NL); Hendricus G. J. Boerstal, Venlo (NL); Stan H. P. Kersten, Venlo (NL); Marinus T. W. Gruntjens, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/939,840

(22) Filed: Nov. 12, 2015

(65) Prior Publication Data

US 2016/0137441 A1 May 19, 2016

(30) Foreign Application Priority Data

Nov. 13, 2014 (EP) ..... 14193054
Nov. 13, 2014 (EP) ..... 14193063

(51) Int. Cl.
*B65H 5/22* (2006.01)
*B41J 13/08* (2006.01)
(Continued)

(52) U.S. Cl.
CPC ..... *B41J 13/08* (2013.01); *B41J 11/002* (2013.01); *B41J 11/007* (2013.01); *B41J 13/22* (2013.01);
(Continued)

(58) Field of Classification Search
CPC ..... B65H 29/56; B65H 5/224; B65H 2301/44735; B65H 2406/322;
(Continued)

(56) References Cited

U.S. PATENT DOCUMENTS 3,605,992 A 9/1971 Weber
3,936,045 A * 2/1976 Ariyama ..... B65H 29/12 226/5
(Continued)

FOREIGN PATENT DOCUMENTS

DE 35 22 755 A1 3/1986
DE 102 08 477 A1 10/2002
(Continued)

*Primary Examiner* — Jeremy R Severson
(74) *Attorney, Agent, or Firm* — Birch, Stewart, Kolasch & Birch, LLP

(57) ABSTRACT

A transport mechanism and method are provided for transporting sheets of a print medium in a printing system. The transport mechanism includes a first conveyor device having a first conveyor body configured to hold a plurality of sheets of print medium and to convey the sheets along the transport path, and a transfer system including a second conveyor device having a second conveyor body configured to hold the sheets and to convey the sheets further along the transport path. The transfer system is configured to transfer the sheets from the first conveyor body to the second conveyor body in a transfer region. The second conveyor body is adjacent the first conveyor body in the transfer region, and the transfer system includes a suction device configured to provide an under-pressure at the second conveyor body for contactless transfer of the sheets from the first conveyor body to the second conveyor body.

16 Claims, 8 Drawing Sheets

(51) Int. Cl.

| | |
|---|---|
| ***B65H 29/56*** | (2006.01) |
| ***B41J 11/00*** | (2006.01) |
| ***B41J 13/22*** | (2006.01) |
| ***B65H 5/02*** | (2006.01) |

(52) U.S. Cl.
CPC ..... *B65H 5/021* (2013.01); *B65H 5/224* (2013.01); *B65H 29/56* (2013.01); *B65H 2301/4474* (2013.01); *B65H 2301/44735* (2013.01); *B65H 2301/517* (2013.01); *B65H 2404/1421* (2013.01); *B65H 2404/1521* (2013.01); *B65H 2404/1531* (2013.01); *B65H 2404/2693* (2013.01); *B65H 2406/322* (2013.01); *B65H 2406/33* (2013.01); *B65H 2601/25* (2013.01)

(58) Field of Classification Search
CPC ..... G03G 15/2028; G03G 15/2085; B41J 11/007; B41J 13/226
USPC ..... 271/900
See application file for complete search history.

(56) References Cited

U.S. PATENT DOCUMENTS

| | | | | |
|---|---|---|---|---|
| 5,031,002 | A * | 7/1991 | Yaguchi | B65H 5/226 271/196 |
| 9,440,466 | B2 * | 9/2016 | Boerstal | B41J 13/08 |
| 2002/0153122 | A1 | 10/2002 | Kelm | |
| 2009/0179928 | A1 | 7/2009 | Nemoto et al. | |
| 2009/0295894 | A1 | 12/2009 | Hori | |
| 2011/0134200 | A1 * | 6/2011 | Ikegami | B41J 11/007 347/104 |
| 2011/0272249 | A1 * | 11/2011 | Berni | B65H 29/003 198/612 |
| 2012/0068401 | A1 | 3/2012 | Kondo et al. | |
| 2012/0281051 | A1 | 11/2012 | Schaeffer | |

FOREIGN PATENT DOCUMENTS

| | | | |
|---|---|---|---|
| EP | 1 127 698 | A1 | 8/2001 |
| EP | 1 493 701 | A1 | 1/2005 |
| EP | 2 030 923 | A2 | 3/2009 |
| EP | 2 386 512 | A1 | 11/2011 |
| EP | 2 612 632 | A1 | 7/2013 |
| EP | 2 689 935 | A1 | 1/2014 |
| FR | 2 954 214 | A1 | 6/2011 |
| JP | 56-36665 | A | 4/1981 |
| JP | 2002-144528 | A | 5/2002 |
| JP | 2007-76175 | A | 3/2007 |
| JP | 2007-108550 | A | 4/2007 |
| JP | 2010-250235 | A | 11/2010 |

* cited by examiner

TRANSPORT MECHANISM AND METHOD FOR TRANSPORTING A PRINT MEDIUM IN A PRINTING SYSTEM

FIELD OF THE INVENTION

The present invention relates to a transport mechanism as well as to a method for transporting a print medium, especially sheets of a print medium, in a printing system, such as an inkjet printing system. The invention also relates to a printing system that incorporates such a transport mechanism to improve and/or optimize productivity of the system.

BACKGROUND OF THE INVENTION

To achieve higher levels of productivity, a printing system must typically process a higher amount or volume of a print medium in a given time period. In many printing systems, the print medium is provided and handled in sheets. Accordingly, such printing systems with higher productivity levels are required to transport the sheets of print medium at higher rates and with greater levels of reliability. In this regard, it is important to transport the sheets of print medium in a manner that substantially avoids imparting any damage or deformation to the sheets. Deformations present within a sheet of a print medium can cause serious reliability problems in a printing system, such as an inkjet printing system. On the one hand, damaged or deformed sheets may lead to a sheet jam in the machinery of the system. On the other hand, if the sheets of printed medium output from the printing system include any such deformations, this naturally compromises the quality of the output and depending on the degree or extent of the deformations in the printed sheets, those sheets may need to be discarded and re-printed.

There are many sources of defects or errors that may degrade the productivity of a printing system. For example, changes in the environmental conditions can lead to deformation of the sheets as they are being processed, and inappropriate settings in the printing system, such as too much ink or a drying temperature that is too high, can also generate problems. A transport mechanism in the printing system will typically employ an under-pressure or suction for holding sheets of the print medium. If an under-pressure or suction is insufficient, deformations or wrinkles known as "cockling" can occur in the sheets, particularly during drying and/or fixing of an image after a printing operation. These influences or defects may also act in combination, thus making it very difficult to identify a root cause of a problem.

SUMMARY OF THE INVENTION

In view of the above, an object of the present invention is to provide a new and improved transport mechanism and method of transporting sheets of print medium in a printing system, such as an inkjet printer, and a printing system or printing machine including such a transport mechanism.

In accordance with the invention, a transport mechanism having the features as recited in claim 1 and/or claim 5 and a method as recited in claim 13 are provided.

Advantageous or preferred features of the invention are recited in the dependent claims.

According to one aspect, therefore, the present invention provides a transport mechanism for transporting sheets of a print medium along a transport path in a printing system, comprising:

a first conveyor device having a first conveyor body which is configured to hold a plurality of sheets of print medium and is movable to convey the sheets along the transport path; and a transfer system comprising a second conveyor device having a second conveyor body which is configured to hold the sheets and is movable to convey the sheets further along the transport path, the transfer system being configured to transfer the sheets from the first conveyor body to the second conveyor body in a transfer region;

wherein the second conveyor body is arranged adjacent the first conveyor body in the transfer region, and the transfer system includes suction means to provide an under-pressure at or in the second conveyor body for contactless transfer of the sheets from the first conveyor body to the second conveyor body, wherein the second conveyor body has a second carrier surface configured to support the sheets thereon and wherein the second conveyor device provides regions on the second carrier surface of different air-flow from the second under-pressure, the second carrier surface including a region of relatively higher suction force or air-flow arranged in a central region of the second carrier surface with respect to the transport path for attracting a centre portion of the each sheet with respect to the transport path towards the second conveyor body in the transfer region.

In this way, the invention provides an arrangement or mechanism for transporting sheets in a printing system and which is designed to affect the transfer of the print medium sheets from one (first) conveyor device to another (second) conveyor device in a reliable and high-speed manner. By virtue of the under-pressure which is provided at the second conveyor body for providing a suction force, and the proximity of the first and second conveyor bodies in the transfer region, the transfer of the sheets can take place without the use of needle elements to engage a leading edge of the sheets on the first conveyor body to separate or redirect the sheets from the first conveyor body. This therefore provides for contactless transfer of the sheets under the influence of air-flow alone, which avoids marking and/or potential damage to the sheet edges which may result from the use of needle elements.

In the present invention, the second conveyor device is configured to provide regions of different under-pressure or air-flow at the second conveyor body or the second carrier surface. In this regard, the second carrier surface has a region of a relatively high second suction force or high air-flow and a region of relatively low second suction force or low air-flow. The region of the relatively high second suction force or high air-flow is located centrally of the second conveyor body or the second carrier surface with respect to the transport path, especially in the transfer region. This has the effect of drawing or attracting a centre portion of each sheet with respect to the transport path from the first conveyor body towards the second conveyor body, with the lateral sides of the sheet with respect to the transport path then following. In this way, the centre portion of the sheet experiences a higher force, meaning that the centre portion of each sheet contacts the second conveyor body first, with the lateral side portions following as the sheet flattens onto the second contact surface. This is particularly desirable for ensuring that the sheet achieves a flat and smooth state upon transfer to the second conveyor body, i.e.

without creasing or wrinkles. As defined herein, a centre portion of the sheet is related to a direction lateral to the transport path.

In a preferred embodiment, said regions on the second carrier surface further include a region of relatively low air-flow for attracting lateral side portions of each sheet, said region of relatively low air-flow surrounding said central region of relatively higher suction force or air-flow in a direction lateral to the transport path.

Said region of relatively low air-flow supports transfer of the lateral side portions of each sheet to the second carrier surface in the transfer region, wherein the lateral side portions of the sheet follow the centre portion of the sheet. In this way, the sheet achieves a flat and smooth state upon transfer to the second conveyor body, i.e. without creasing or wrinkles.

As defined herein, lateral side portions of the sheet are side portions in a direction lateral to the transport path.

In a preferred embodiment, the under-pressure at or in the second conveyor body is provided to overcome a holding force on the sheets of print medium on the first conveyor body. In this regard, the transfer system preferably comprises release means for releasing a holding force on the sheets of print medium on the first conveyor body at the transfer region. By releasing a holding force acting on the sheets to hold them on the first conveyor body as the first conveyor body moves or conveys the sheets into the transfer region, the sheets are then more readily able to be transferred to the second conveyor body under the influence of the under-pressure at the second conveyor body. In a particularly preferred embodiment, the first conveyor device includes suction means configured to provide a first under-pressure at the first conveyor body to hold the sheets fixed in position on the first conveyor body as it conveys the plurality of sheets along the transport path. The release means may then comprise means for reducing, excluding or eliminating that first under-pressure in the transfer region.

According to another aspect, therefore, the present invention provides a transport mechanism for transporting sheets of a print medium along a transport path in a printing system, comprising:

a first conveyor device comprising: a first conveyor body for supporting a plurality of sheets of print medium and being movable to convey the sheets along the transport path, and suction means which provides a first under-pressure at the first conveyor body to hold the sheets fixed in position on the first conveyor body as it conveys the plurality of sheets along the transport path; and a transfer system comprising a second conveyor device having a second conveyor body for supporting the sheets and being movable to convey the sheets further along the transport path, the transfer system being configured to transfer the sheets of print medium from the first conveyor body to the second conveyor body in a transfer region, wherein the transfer system comprises means for reducing, excluding or eliminating the first under-pressure in the transfer region.

In a preferred embodiment, the first conveyor body is provided as a drum member and an outer periphery or circumference of the drum member forms a first carrier surface for supporting the plurality of sheets thereon. The suction means therefore provides the first under-pressure within the drum member, and the drum member is rotatable about a central axis to convey the sheets along the transport path. The first carrier surface preferably includes holes or apertures which communicate the first under-pressure provided by the suction means and which are at least partially covered by the plurality of sheets of print medium held fixed in position on the carrier surface. In other words, the first conveyor device may include first suction means, especially fan means, for generating a first under-pressure at or adjacent to the first conveyor body, and especially at the first carrier surface, to hold the sheets of print medium fixed in position thereon as the first conveyor body conveys the plurality of sheets along the transport path. Thus, the fan means is typically configured and arranged generate the desired first under-pressure or suction at the first carrier surface and, in turn, to generate an air-flow through the carrier surface (e.g. through the holes or apertures) into the first conveyor body to hold the print medium sheets fixed to the first carrier surface. Accordingly, where the first conveyor body is provided as a drum member configured to support the print medium sheets on an outer periphery or a circumference thereof, the first suction means or fan means may be arranged to communicate with and/or to act upon a cavity enclosed by the drum. In this regard, the suction means may comprise a centrifugal fan and/or one or more axial fan, which generates or provides the first under-pressure within the drum member.

By reducing, excluding or eliminating the first under-pressure in the transfer region, the force that holds the sheets of print medium fixed in position on the first carrier surface of the first conveyor body (e.g. on the outer periphery of the drum member) can be reduced or weakened, or even entirely eliminated, in the transfer region. This, in turn, facilitates a separation of the sheets from the first conveyor body to assist a transfer of same to the second conveyor body. In this context, the means for reducing, excluding or eliminating the first under-pressure in the transfer region preferably includes shielding means for shielding a section of the first conveyor body from the effect of the suction means. More particularly, the shielding means may comprise one or more baffle member arranged within the first conveyor body (e.g. in the drum body or drum member), such that the baffle member(s) shield or shutter a section or portion of the first carrier surface (e.g. the drum periphery or circumference) in the transfer region. In addition to reducing or eliminating the first under-pressure within the first conveyor body in the transfer region, the first conveyor body may be provided with an over-pressure in the transfer region to provide an impulse or positive pressure which serves or operates to promote or initiate separation of the sheets from the first conveyor body in the transfer region.

In a preferred embodiment, the second conveyor device includes suction means, such as fan means, for providing a second under-pressure at or adjacent to the second conveyor body, especially at the second carrier surface, to hold the sheets fixed in position thereon as the second conveyor body conveys the sheets further along the transport path. The second conveyor body preferably comprises a belt member and typically includes holes or apertures configured and arranged to communicate the second under-pressure provided by the suction means, wherein the holes or apertures are at least partially covered by the sheets of print medium supported on the second carrier surface, i.e. on the belt outer surface. The suction means or fan means of the second conveyor device is arranged to communicate with and/or to act upon a cavity within or covered by the belt member and may again comprise a centrifugal fan and/or one or more axial fan. As the second conveyor body is arranged adjacent or proximate the first conveyor body in the transfer region of the transfer system, in which the first under-pressure is reduced or eliminated, the second under-pressure of the second conveyor body acts or operates to transfer the sheets of print medium from the first conveyor body to the second conveyor body in the transfer region. That is, as a print medium sheet enters the transfer region held fixed to the first carrier surface of the first conveyor body, the reduction or elimination of the first under-pressure and the air-flow into the second conveyor body causes a leading edge of the sheet to separate or be drawn away from the first conveyor body across a predefined spacing or gap and into contact with the second conveyor body. As that sheet continues along the transport path, the remainder of the sheet progressively enters the transfer region where the first under-pressure dissipates or disappears and the second under-pressure separates or draws the sheet onto the second conveyor body. Thus, the transfer of the sheets via the transfer system is contactless in the sense that no finger or guide elements make contact with the edge of the sheets to effect the separation from the first conveyor body. This avoids the risk of damage to the edges of the sheets thus improves the output quality from the printing system.

In a preferred embodiment, the transfer system includes spacer means which is configured to maintain a predefined spacing between the first conveyor body and the second conveyor body in the transfer region. To provide reliable and continual transfer of the sheets, the spacer means may therefore provide a space or gap (i.e. a spacing or separation gap) between the first and second conveyor devices which is not only small, but which is able to be kept at a predefined constant value. The spacer means is preferably configured and arranged to maintain contact with the first conveyor body as the first conveyor body moves to convey the sheets of print medium along the transport path. By maintaining contact with the first conveyor body, the spacer means can continuously set, define and/or control the spacing to the first conveyor body as that first conveyor body moves. To this end, the spacer means is preferably biased into contact with the first conveyor body, especially via resilient spring means. In a particularly preferred embodiment, the spacer means is configured and arranged to make contact with the first conveyor body in the transfer region of the transfer system. In this way, the spacing or gap between the first and second conveyor devices is defined or fixed most accurately by locating the spacer means in precisely that region where the transfer of the sheets of print medium takes place. It will be appreciated, however, that the spacer means need not make contact in the transfer region in order to predefine or set the spacing in that region.

In a preferred embodiment of the invention, the spacer means comprises at least one roller, e.g. a spacer roller or follower roller, having a predetermined diameter, and a periphery of the at least one spacer roller is configured and arranged to make and to maintain contact with the first carrier surface of the first conveyor body. As noted above, the first conveyor body may be provided as a drum body or drum member, and an outer periphery or circumference of the drum member may form the first carrier surface for the plurality of sheets. The drum member typically has a circular cylindrical form and is rotatable about a central axis to convey the sheets along the transport path. By following the outer surface (i.e. carrier surface) of the drum member with the at least one spacer roller or wheel in continuous contact therewith, the transport mechanism of the invention is able to eliminate or overcome deviations in the spacing or separation gap caused by any one or more of manufacturing tolerances in the diameter of the drum, temperature differences (e.g. thermal expansion or contraction), and radial run-out of the drum. With the transport mechanism of the invention, the spacing or separation gap can be kept or held at a precise and constant size or value. Furthermore, the spacing or gap can be kept very small; for example, in the range of 0 mm to 5 mm, preferably in the range of 0 mm to 3 mm, more preferably in the range of 0 mm to 2 mm, and even more preferably in the range of 0 mm to 1 mm. A constant and small spacing or gap is particularly important for realizing a contactless transfer of the sheets from the first conveyor body to the second conveyor body. Without the spacer means, the total sum of tolerances in the surrounding components would result in a value greater than the gap itself, generating a significant variation in the spacing, a high likelihood of sheet jams, and potential damage to the transport mechanism.

In a preferred embodiment, the transfer system comprises a support frame or at least one frame member upon which the second conveyor device is supported or mounted. The second conveyor body includes a second carrier surface configured to support the plurality of sheets in series thereon. This support frame or at least one frame member is movable relative to the first conveyor body. Furthermore, the at least one spacer roller or follower roller is mounted on the support frame or frame member for rotation about its central axis. To predefine the spacing between the first and second conveyor bodies in the transfer region, the predetermined diameter of the spacer roller or follower roller is selected such that the periphery of the roller, which is in contact with the first conveyor body (and particularly with the first carrier surface thereof), projects beyond the second carrier surface of the second conveyor body by the predefined spacing.

In a particular embodiment, the at least one spacer roller is positioned to arrange the predefined gap or spacing in the region of relatively higher under-pressure. In this way, a crease free transfer of the sheet to the second conveyor body is enhanced. The centre portion of the sheet experiences the highest force at the predefined gap provided by the spacer roller, meaning that the centre portion of each sheet contacts the second conveyor body first, with the lateral side portions following as the sheet flattens onto the second contact surface. In a particular example, the at least one spacer roller is positioned to arrange the predefined gap or spacing at a position in the media transport direction, wherein the region of relatively higher under-pressure is at its widest perpendicular to the media transport direction.

In a particularly preferred embodiment, the transfer system includes at least two frame members, upon each of which at least one said spacer roller is mounted for rotation about its central axis, and the second conveyor body is supported between the at least two frame members. The two frame members are preferably movable independently of one another relative to the first conveyor body, especially in a direction substantially perpendicular to the transport path. Where the first conveyor body is provided as a drum body or a drum member, the support frame and/or each frame member of the transfer system is preferably mounted for pivoting movement about a pivot axis which extends substantially parallel to a central axis of the drum.

Thus, the predefined spacing is preferably provided by supporting the second conveyor body adjacent and proximate the first carrier surface of the first conveyor drum body via two spacer rollers or wheels. These spacer rollers or wheels may be connected to the frame of the transfer system precisely in the transfer region of the spacing or separation gap. Furthermore, because each spacer roller or wheel is respectively mounted on one of two independently movable frame members, between which the second conveyor body is supported, one spacer roller or wheel may be positioned on one (front) side of the second conveyor body, while the other spacer roller or wheel is positioned on the other (rear) side of the second conveyor body. This allows the spacer rollers/wheels, and thus the transfer system, to follow movements and positions of the drum carrier surface separately or independently between a front side and a rear side of the system. In this way, also, the transport mechanism of the invention is able to compensate for various positioning errors, including: a positioning error of the drum relative to the frame member(s); a positioning error of the transfer system on the frame member(s); parallelism error of the drum carrier surface relative to the frame; and parallelism error of the transfer system relative to the frame member(s).

In a preferred embodiment, the transfer system comprises a third conveyor device downstream of the second conveyor device along the transport path for conveying the sheets further along the transport path. The third conveyor device preferably comprises one or more sheet guide members defining a portion of the transport path and a plurality of feed rollers for conveying the sheets along that portion of the transport path. The third conveyor device is preferably supported or mounted on the one or more frame members that support the second conveyor device. The feed rollers preferably include a nip through which the sheets of print medium are fed and conveyed. By connecting or supporting the one or more guide members and the rollers on the same support frame as the second conveyor device, the nip and guide members are always in accurate alignment with the second conveyor body (e.g. the belt member), which improves the sheet feed or sheet transport reliability. In this way, any movement of the frame members around their pivot axis (e.g. due to radial run-out of the drum member, or heat expansion) does not affect the alignment of the feed rollers (nip) or the guide members relative to the second conveyor body (e.g. the belt member). One or more of the feed rollers may be configured and arranged to apply a laterally outwards directed force to the sheets of print medium passing through the third conveyor device. In this way, the rollers may act to smooth the sheets against the one or more sheet guide members and inhibit wrinkling. To this end, at least one of the rollers may be configured with a frusto-conical form and may be positioned to engage the sheets of print medium on the transport path in a laterally outward or side portion thereof.

In a particularly preferred embodiment, the transfer system includes a transfer unit comprising the second conveyor device and/or the third conveyor device mounted or supported on the support frame or frame members.

In a preferred embodiment, the transport mechanism comprises a fourth conveyor device downstream of the third conveyor device, and especially downstream of the transfer unit, along the transport path for conveying the sheets further along the transport path. The fourth conveyor device preferably includes one or more sheet guide members defining a portion of the transport path and a plurality of feed rollers for conveying the sheets along that portion of the transport path. The sheet guide members of the fourth conveyor device are typically fixed to and stationary on a base frame of the transport mechanism. A sheet inlet to the fourth conveyor device is preferably arranged proximate to a pivot axis of the support frame or the frame members of the transfer unit. Because this transition area for the sheets of print medium travelling along the transport path from the transfer unit (e.g. from a third conveyor device) to the fourth conveyor device is located proximate or close to the pivot axis of the transfer unit support frame, a misalignment of the inlet or the sheet guide members can be held to a minimum. That is, although the transfer unit is movable to accommodate movement or deviations of the first carrier surface (e.g. an outer surface of the drum member) while the sheet inlet or sheet guide members of the fourth conveyor device are stationary, the location of the sheet inlet to the fourth conveyor device nevertheless minimizes any misalignment in a transition of the sheets from the transfer unit to the fourth conveyor device, which also helps to improve the sheet feed or transport reliability.

In a preferred embodiment, the transport mechanism of the invention is provided in a drying and fixing unit of the printing system, such that the transport mechanism is designed for transporting the plurality of sheets of the print medium along the transport path for drying and fixing ink printed on the sheets downstream of the image forming unit of the printing system. As will be appreciated, however, the transport mechanism may also be arranged at other locations in a sheet transport path of the printing system. As noted above, the drying and fixing unit in an inkjet printing system will typically include a drum-shaped conveyor body, which forms the first conveyor body. A large centrifugal fan is typically used to provide sufficient under-pressure to prevent deformation ("cockling") during drying of the sheets on the periphery of the drum.

In a preferred embodiment, each of the sheets to be printed is a sheet of a print medium selected from the group comprised of: paper, polymer film, such as poly-ethylene (PE) film, polypropylene (PP) film, polyethylene terephthalate (PET) film, metallic foil, or a combination of two or more thereof. Paper is especially preferred as the print medium and each sheet of paper typically has a density in the range of 50 g to 350 g per square meter.

According to a further aspect, the present invention provides a printing system comprising a transport mechanism for transporting a plurality of sheets of a print medium according to any one of the embodiments described above. As noted above, in a preferred form of the invention, the transport mechanism is provided in a drying and fixing unit of the printing system.

According to yet another aspect, the invention provides a method of transporting sheets of print medium in a printing system, comprising:

- holding a plurality of sheets of a print medium on a first conveyor body in a first conveyor device and moving, especially rotating, the first conveyor body to convey the sheets along a transport path;
- providing a second conveyor device having a second conveyor body for holding the sheets and which is movable to convey the sheets further along the transport path;
- releasing the sheets of print medium from the first conveyor body in a transfer region; and
- attracting the sheets to the moving second conveyor body of a second conveyor device in the transfer region to convey the sheets further along the transport path, wherein the second conveyor body has a second carrier surface configured to support the sheets thereon;
- wherein the step of attracting the sheets to the second conveyor body comprises providing a second suction force or second under-pressure in or at the second conveyor body, wherein the second conveyor device provides regions of different air-flow from the second under-pressure over the second carrier surface, and wherein in a central region of the second carrier surface with respect to the transport path the sheet is attracted by a relatively higher suction force or air-flow to attract a centre portion of the sheet with respect to the transport path towards the second conveyor body.

In this way, the centre portion of the sheet experiences a higher force, meaning that the centre portion of each sheet with respect to the transport path contacts the second conveyor body first, with the lateral side portions with respect to the transport path following as the sheet flattens onto the second contact surface. Thus, the sheets entering the transfer region of the transfer system are attracted or drawn towards the belt member predominantly at a centre portion of the sheet.

This is particularly desirable for ensuring that the sheet achieves a flat and smooth state upon transfer to the second conveyor body, i.e. without creasing or wrinkles.

In a preferred embodiment of the method, the step of holding a plurality of sheets on the first conveyor body includes providing a first suction force or first under-pressure to hold the sheets fixed in position on the first conveyor body as it moves to convey the sheets along a transport path. The step of releasing the sheets of print medium from the first conveyor body then preferably comprises reducing, excluding or eliminating the first under-pressure in the transfer region. As noted above, this may be achieved by shielding a section of the first conveyor body from the suction force or under-pressure. More particularly, the shielding may comprise shielding or shuttering a section or portion of the first carrier surface (e.g. the drum periphery or circumference) in the transfer region.

In a preferred embodiment of the method, the step of attracting the sheets to the second conveyor body further comprises providing the second suction force or second under-pressure in or at the second conveyor body to hold the sheets fixed in position on the second carrier surface (32) of the second conveyor body as it moves to convey the sheets further along the transport path.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference characters designate like parts and in which.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

DETAILED DESCRIPTION OF EMBODIMENTS

Figure 1:
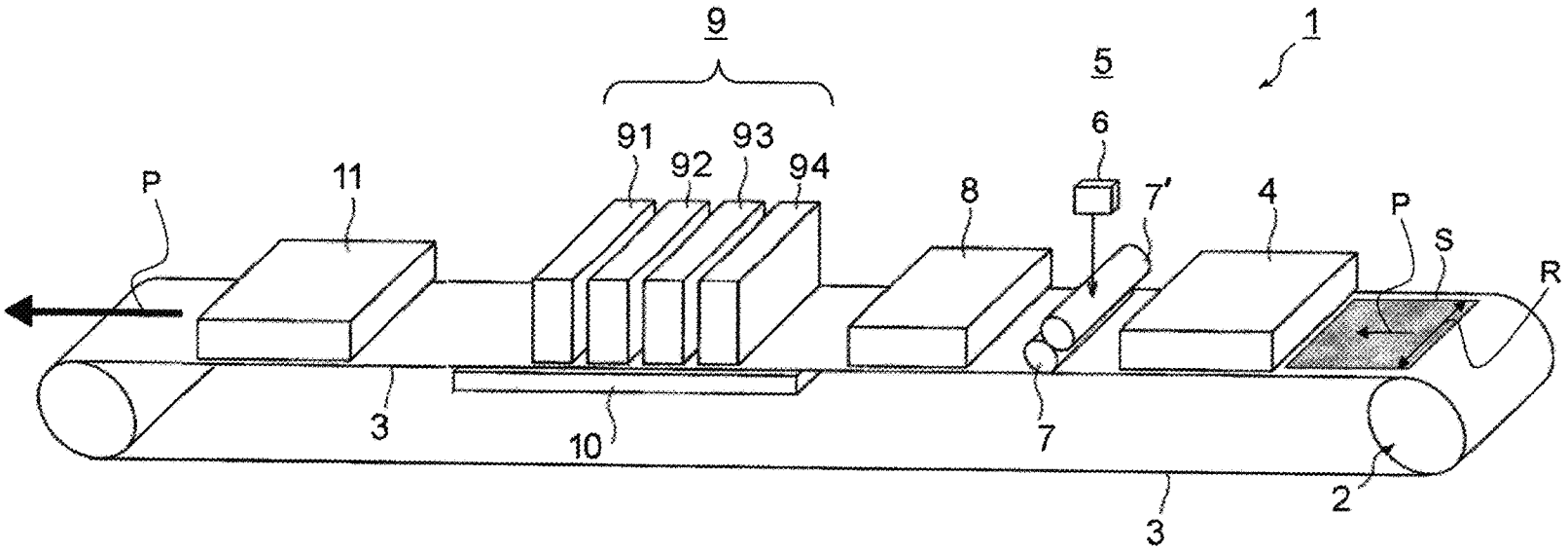
FIG. 1 is a schematic illustration of a printing system according to an embodiment of the invention.

With reference to FIG. 1 of the drawings, an inkjet printing system 1 according to an embodiment of the invention is shown highly schematically. FIG. 1 illustrates in particular the following parts or steps of the printing process in the inkjet printing system 1: media pre-treatment, image formation, drying and fixing, and optionally post treatment. Each of these will be discussed briefly below.

FIG. 1 shows that a sheet S of a receiving medium or print medium, in particular a machine-coated print medium, is transported or conveyed along a transport path P of the system 1 with the aid of transport mechanism 2 in a direction indicated by arrows P. The transport mechanism 2 is represented here merely schematically and may comprise a one or more driven belt system having one or more endless belt 3. One or more of the belts 3 may, however, be replaced with one or more drums (not shown). Indeed, the transport mechanism 2 may be suitably configured or adapted to the requirements of the sheet transport in each step of the printing process (e.g. sheet registration accuracy) and may hence comprise multiple driven belts and/or multiple drums. To ensure proper conveyance of the sheets S of the receiving medium or print medium, the sheets S are preferably fixed to or held by the transport mechanism 2. The manner of such fixation is not limited but typically includes vacuum fixation (e.g. via suction or under-pressure) although electrostatic fixation and/or mechanical fixation (e.g. clamping) may also be employed.

Media Pre-Treatment

To improve spreading and pinning (i.e. fixation of pigments and water-dispersed polymer particles) of the ink on the print medium, in particular on slow absorbing media, such as machine-coated media, the print medium may be pre-treated, i.e. treated prior to the printing of an image on the medium. The pre-treatment step may comprise one or more of the following:

(i) pre-heating of the print medium to enhance spreading of the ink used on the print medium and/or to enhance absorption into the print medium of the ink used;

(ii) primer pre-treatment for increasing the surface tension of print medium in order to improve the wettability of the print medium by the ink used and to control the stability of the dispersed solid fraction of the ink composition, i.e. pigments and dispersed polymer particles; (N.B. primer pre-treatment can be performed in a gas phase, e.g. with gaseous acids such as hydrochloric acid, sulphuric acid, acetic acid, phosphoric acid and lactic acid, or in a liquid phase by coating the print medium with a pre-treatment liquid. A pre-treatment liquid may include water as a solvent, one or more co-solvents, additives such as surfactants, and at least one compound selected from a polyvalent metal salt, an acid and a cationic resin); and (iii) corona or plasma treatment.

FIG. 1 illustrates that the sheet S of print medium may be conveyed to and passed through a first pre-treatment module 4, which module may comprise a preheater, (e.g. a radiation heater), a corona/plasma treatment unit, a gaseous acid treatment unit or a combination of any of these. Subsequently, a predetermined quantity of the pre-treatment liquid may optionally be applied on a surface of the print medium via a pre-treatment liquid applying device 5. Specifically, the pre-treatment liquid is provided from a storage tank 6 to the pre-treatment liquid applying device 5, which comprises double rollers 7, 7'. A surface of the double rollers 7, 7' may be covered with a porous material, such as sponge. After providing the pre-treatment liquid to auxiliary roller 7' first, the pre-treatment liquid is transferred to main roller 7, and a predetermined quantity is applied onto the surface of the print medium. Thereafter, the coated printing medium (e.g. paper) onto which the pre-treatment liquid was applied may optionally be heated and dried by a dryer device 8, which comprises a dryer heater installed at a position downstream of the pre-treatment liquid applying device 5 in order to reduce the quantity of water content in the pre-treatment liquid to a predetermined range. It is preferable to decrease the water content in an amount of 1.0 weight % to 30 weight % based on the total water content in the pre-treatment liquid provided on the print medium sheet S. To prevent the transport mechanism 2 from being contaminated with pre-treatment liquid, a cleaning unit (not shown) may be installed and/or the transport mechanism 2 may include a plurality of belts or drums 3, 3', as noted above. The latter measure avoids or prevents contamination of other parts of the printing system 1, particularly of the transport mechanism 2 in the printing region.

It will be appreciated that any conventionally known methods can be used to apply the pre-treatment liquid. Specific examples of an application technique include: roller coating (as shown), ink-jet application, curtain coating and spray coating. There is no specific restriction in the number of times the pre-treatment liquid may be applied. It may be applied just one time, or it may be applied two times or more. An application twice or more may be preferable, as cockling of the coated print medium can be prevented and the film formed by the surface pre-treatment liquid will produce a uniform dry surface with no wrinkles after application twice or more. A coating device 5 that employs one or more rollers 7, 7' is desirable because this technique does not need to take ejection properties into consideration and it can apply the pre-treatment liquid homogeneously to a print medium. In addition, the amount of the pre-treatment liquid applied with a roller or with other means can be suitably adjusted by controlling one or more of: the physical properties of the pre-treatment liquid, the contact pressure of the roller, and the rotational speed of the roller in the coating device. An application area of the pre-treatment liquid may be only that portion of the sheet S to be printed, or an entire surface of a print portion and/or a non-print portion. However, when the pre-treatment liquid is applied only to a print portion, unevenness may occur between the application area and a non-application area caused by swelling of cellulose contained in coated printing paper with water from the pre-treatment liquid followed by drying. From a view-point of uniform drying, it is thus preferable to apply a pre-treatment liquid to the entire surface of a coated printing paper, and roller coating can be preferably used as a coating method to the whole surface. The pre-treatment liquid may be an aqueous liquid.

Corona or plasma treatment may be used as a pre-treatment step by exposing a sheet of a print medium to corona discharge or plasma treatment. In particular, when used on media such as polyethylene (PE) films, polypropylene (PP) films, polyethylene terephthalate (PET) films and machine coated media, the adhesion and spreading of the ink can be improved by increasing the surface energy of the medium. With machine-coated media, the absorption of water can be promoted which may induce faster fixation of the image and less puddling on the print medium. Surface properties of the print medium may be tuned by using different gases or gas mixtures as medium in the corona or plasma treatment. Examples of such gases include: air, oxygen, nitrogen, carbon dioxide, methane, fluorine gas, argon, neon, and mixtures thereof. Corona treatment in air is most preferred.

Image Formation

When employing an inkjet printer loaded with inkjet inks, the image formation is typically performed in a manner whereby ink droplets are ejected from inkjet heads onto a print medium based on digital signals. Although both single-pass inkjet printing and multi-pass (i.e. scanning) inkjet printing may be used for image formation, single-pass inkjet printing is preferable as it is effective to perform high-speed printing. Single-pass inkjet printing is an inkjet printing method with which ink droplets are deposited onto the print medium to form all pixels of the image in a single passage of the print medium through the image forming device, i.e. beneath an inkjet marking module.

Referring to FIG. 1, after pre-treatment, the sheet S of print medium is conveyed on the transport belt 3 to an image forming device or inkjet marking module 9, where image formation is carried out by ejecting ink from inkjet marking device 91, 92, 93, 94 arranged so that a whole width of the sheet S is covered. That is, the image forming device 9 comprises an inkjet marking module having four inkjet marking devices 91, 92, 93, 94, each being configured and arranged to eject an ink of a different color (e.g. Cyan, Magenta, Yellow and Black). Such an inkjet marking device 91, 92, 93, 94 for use in single-pass inkjet printing typically has a length corresponding to at least a width of a desired printing range R (i.e. indicated by the double-headed arrow on sheet S), with the printing range R being perpendicular to the media transport direction along the transport path P.

Figure 2:
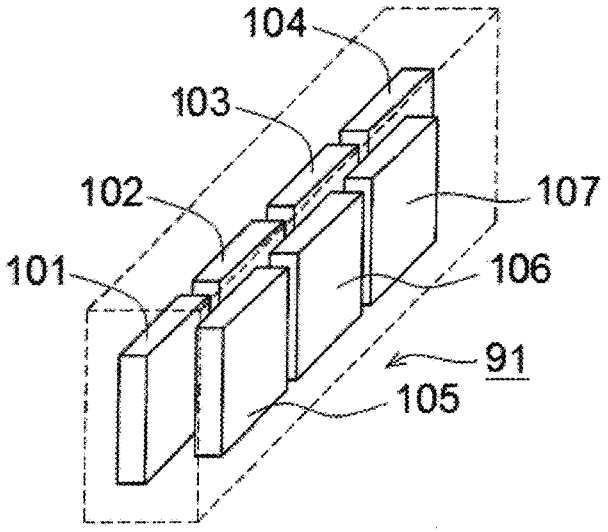
FIG. 2 is a schematic perspective view of an image forming device in the printing system of FIG. 1.
Figure 3A:
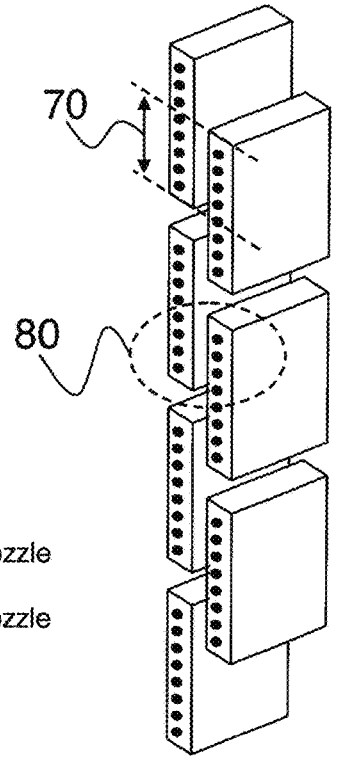
FIG. 3A is a schematic perspective underside view of printing heads in the image forming device of FIG. 2.
Figure 3B:
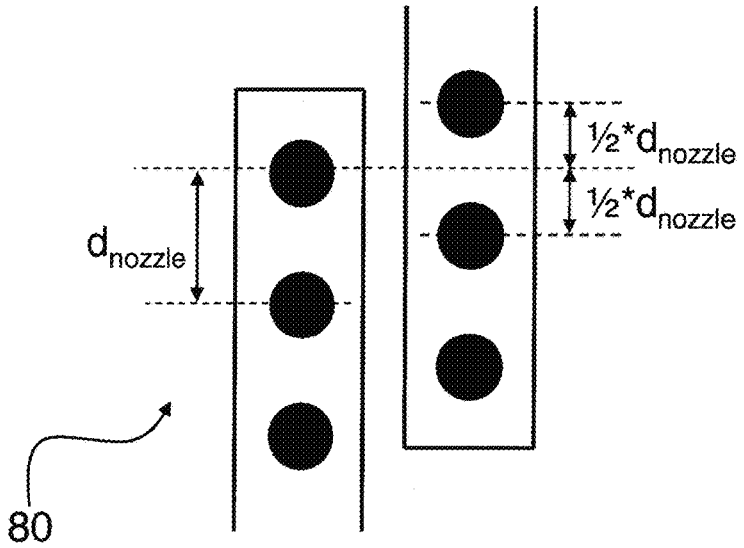
FIG. 3B is a detailed view of the printing heads in the image forming device of FIG. 2 and FIG. 3A.

Each inkjet marking device 91, 92, 93, 94 may have a single print head having a length corresponding to the desired printing range R. Alternatively, as shown in FIG. 2, the inkjet marking device 91 may be constructed by combining two or more inkjet heads or printing heads 101-107, such that a combined length of individual inkjet heads covers the entire width of the printing range R. Such a construction of the inkjet marking device 91 is termed a page wide array (PWA) of print heads. As shown in FIG. 2, the inkjet marking device 91 (and the others 92, 93, 94 may be identical) comprises seven individual inkjet heads 101-107 arranged in two parallel rows, with a first row having four inkjet heads 101-104 and a second row having three inkjet heads 105-107 arranged in a staggered configuration with respect to the inkjet heads 101-104 of the first row. The staggered arrangement provides a page-wide array of inkjet nozzles 90, which nozzles are substantially equidistant in the length direction of the inkjet marking device 91. The staggered configuration may also provide a redundancy of nozzles in an area O where the inkjet heads of the first row and the second row overlap. (See in FIG. 3A). The staggering of the nozzles 90 may further be used to decrease an effective nozzle pitch d (and hence to increase print resolution) in the length direction of the inkjet marking device 91. In particular, the inkjet heads are arranged such that positions of the nozzles 90 of the inkjet heads 105-107 in the second row are shifted in the length direction of the inkjet marking device 91 by half the nozzle pitch d, the nozzle pitch d being the distance between adjacent nozzles 90 in an inkjet head 101-107. (See FIG. 3B, which shows a detailed view of 80 in FIG. 3A). The nozzle pitch d of each head is, for example, about 360 dpi, where "dpi" indicates a number of dots per 2.54 cm (i.e. dots per inch). The resolution may be further increased by using more rows of inkjet heads, each of which are arranged such that the positions of the nozzles of each row are shifted in the length direction with respect to the positions of the nozzles of all other rows.

In the process of image formation by ejecting ink, an inkjet head or a printing head employed may be an on-demand type or a continuous type inkjet head. As an ink ejection system, an electrical-mechanical conversion system (e.g. a single-cavity type, a double-cavity type, a bender type, a piston type, a shear mode type, or a shared wall type) or an electrical-thermal conversion system (e.g. a thermal inkjet type, or a Bubble Jet® type) may be employed. Among them, it is preferable to use a piezo type inkjet recording head which has nozzles of a diameter of 30 μm or less in the current image forming method.

The image formation via the inkjet marking module 9 may optionally be carried out while the sheet S of print medium is temperature controlled. For this purpose, a temperature control device 10 may be arranged to control the temperature of the surface of the transport mechanism 2 (e.g. belt or drum 3) below the inkjet marking module 9. The temperature control device 10 may be used to control the surface temperature of the sheet S within a predetermined range, for example in the range of 30° C. to 60° C. The temperature control device 10 may comprise one or more heaters, e.g. radiation heaters, and/or a cooling means, for example a cold blast, in order to control and maintain the surface temperature of the print medium within the desired range. During and/or after printing, the print medium is conveyed or transported downstream through the inkjet marking module 9.

Drying and Fixing

After an image has been formed on the print medium, the printed ink must be dried and the image must be fixed on the print medium. Drying comprises evaporation of solvents, and particularly those solvents that have poor absorption characteristics with respect to the selected print medium.

FIG. 1 of the drawings schematically shows a drying and fixing unit 11, which may comprise one or more heater, for example a radiation heater. After an image has been formed on the print medium sheet S, the sheet S is conveyed to and passed through the drying and fixing unit 11. The ink on the sheet S is heated such that any solvent present in the printed image (e.g. to a large extent water) evaporates. The speed of evaporation, and hence the speed of drying, may be enhanced by increasing the air refresh rate in the drying and fixing unit 11. Simultaneously, film formation of the ink occurs, because the prints are heated to a temperature above the minimum film formation temperature (MFT). The residence time of the sheet S in the drying and fixing unit 11 and the temperature at which the drying and fixing unit 11 operates are optimized, such that when the sheet S leaves the drying and fixing unit 11 a dry and robust image has been obtained.

As described above, the transport mechanism 2 in the fixing and drying unit 11 may be separate from the transport mechanism 2 of the pre-treatment and printing parts or sections of the printing system 1 and may comprise a belt and/or a drum. Preferably, the transport mechanism 2 in the fixing and drying unit 11 comprises a drum and includes means, such as one or more fan, especially a centrifugal fan, for generating an under-pressure or suction for holding a plurality of sheets S of print medium in contact with an outer periphery of the drum. Further details of this embodiment of the transport mechanism 2 in the fixing and drying unit 11 will be described later.

Post Treatment

To improve or enhance the robustness of a printed image or other properties, such as gloss level, the sheet S may be post treated, which is an optional step in the printing process. For example, in a preferred embodiment, the printed sheets S may be post-treated by laminating the print image. That is, the post-treatment may include a step of applying (e.g. by jetting) a post-treatment liquid onto a surface of the coating layer, onto which the ink has been applied, so as to form a transparent protective layer over the printed recording medium. In the post-treatment step, the post-treatment liquid may be applied over the entire surface of an image on the print medium or it may be applied only to specific portions of the surface of an image. The method of applying the post-treatment liquid is not particularly limited, and may be selected from various methods depending on the type of the post-treatment liquid. However, the same method as used in coating the pre-treatment liquid or an inkjet printing method is preferable. Of these, an inkjet printing method is particularly preferable in view of: (i) avoiding contact between the printed image and the post-treatment liquid applicator; (ii) the construction of an inkjet recording apparatus used; and (iii) the storage stability of the post-treatment liquid. In the post-treatment step, a post-treatment liquid containing a transparent resin may be applied on the surface of a formed image so that a dry adhesion amount of the post-treatment liquid is 0.5 $g/m^2$ to 10 $g/m^2$, preferably 2 $g/m^2$ to 8 $g/m^2$, thereby to form a protective layer on the recording medium. If the dry adhesion amount is less than 0.5 $g/m^2$, little or no improvement in image quality (image density, color saturation, glossiness and fixability) may be obtained. If the dry adhesion amount is greater than 10 $g/m^2$, on the other hand, this can be disadvantageous from the view-point of cost efficiency, because the dryness of the protective layer degrades and the effect of improving the image quality is saturated.

As a post-treatment liquid, an aqueous solution comprising components capable of forming a transparent protective layer over the print medium sheet S (e.g. a water-dispersible resin, a surfactant, water, and other additives as required) is preferably used. The water-dispersible resin in the post-treatment liquid preferably has a glass transition temperature (Tg) of −30° C. or higher, and more preferably in the range of −20° C. to 100° C. The minimum film forming temperature (MFT) of the water-dispersible resin is preferably 50° C. or lower, and more preferably 35° C. or lower. The water-dispersible resin is preferably radiation curable to improve the glossiness and fixability of the image. As the water-dispersible resin, for example, any one or more of an acrylic resin, a styrene-acrylic resin, a urethane resin, an acryl-silicone resin, a fluorine resin or the like, is preferably employed. The water-dispersible resin can be suitably selected from the same materials as that used for the inkjet ink. The amount of the water-dispersible resin contained, as a solid content, in the protective layer is preferably 1% by mass to 50% by mass. The surfactant used in the post-treatment liquid is not particularly limited and may be suitably selected from those used in the inkjet ink. Examples of the other components of the post-treatment liquid include antifungal agents, antifoaming agents, and pH adjustors.

Hitherto, the printing process was described such that the image formation step was performed in-line with the pre-treatment step (e.g. application of an (aqueous) pre-treatment liquid) and a drying and fixing step, all performed by the same apparatus, as shown in FIG. 1. However, the printing system 1 and the associated printing process are not restricted to the above-mentioned embodiment. A system and method are also contemplated in which two or more separate machines are interconnected through a transport mechanism 2, such as a belt conveyor 3, drum conveyor or a roller, and the step of applying a pre-treatment liquid, the (optional) step of drying a coating solution, the step of ejecting an inkjet ink to form an image and the step or drying an fixing the printed image are performed separately. Nevertheless, it is still preferable to carry out the image formation with the above defined in-line image forming method and printing system 1.

Transport Mechanism

Figure 4:
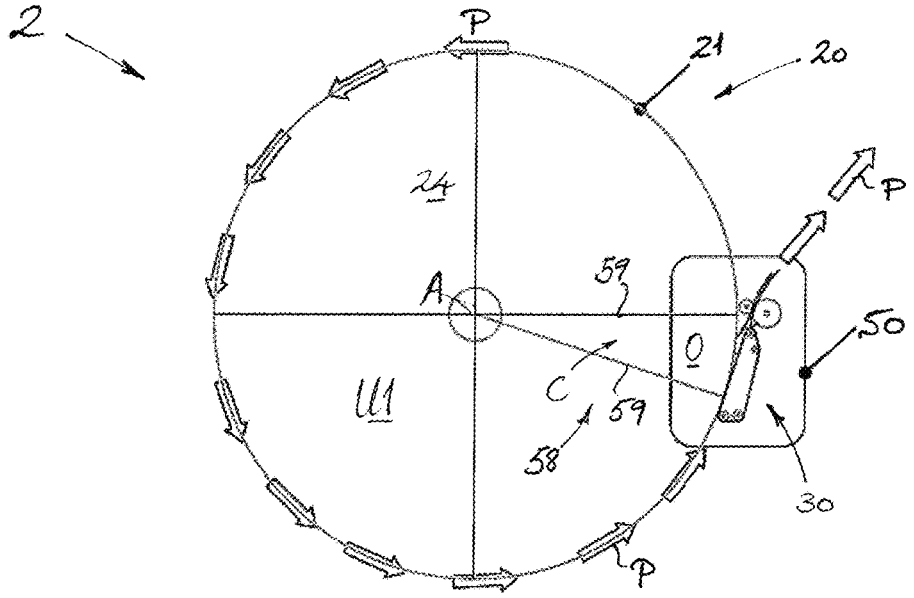
FIG. 4 is a schematic side view of a transport mechanism for sheets of print medium in a printing system according to a preferred embodiment of the invention.

With reference to FIG. 4 of the drawings, a transport mechanism 2 for transporting the sheets S of print medium along a transport path P (i.e. represented by arrows) in the drying and fixing unit 11 of the printing system 1 according to a preferred embodiment of the invention is shown schematically. The transport mechanism 2 in the fixing and drying unit 11 comprises a first conveyor device 20 having a first conveyor body 21 formed as a generally cylindrical drum member, which in this example has a diameter of about 1 meter. An outer periphery or circumference of the cylindrical drum member 21 forms a first carrier surface 22 for supporting and holding the plurality of sheets S delivered to the fixing and drying unit 11 from the image forming device 9. The drum body 21 is configured to rotate about its central axis A and thus conveys the sheets S, which are held and supported in series around the carrier surface 22, along the transport path P as the drum member 21 rotates. To hold the sheets S fixed in position on the drum member 21, the first carrier surface 22 includes an array of holes or apertures 23 which are distributed over or around the periphery of the drum member 21. The first conveyor device 20 further includes first suction means comprising a large centrifugal fan (not shown) arranged for communication with an interior cavity 24 of the drum member 21. This centrifugal fan acts or operates as the suction means by generating a first under-pressure U1 within drum member 21, which in turn produces or draws an air-flow into the drum member 21 from outside through the holes or apertures 23 formed through the carrier surface 22. In this way, when the sheets S of print medium are sequentially delivered to the first conveyor device 20 from the image forming device 9, the sheets S are sucked onto and firmly held on the carrier surface 22 of the rotating drum member 21 by means of the first under-pressure U1. The drum member 21 is preferably heated to assist drying and fixing of the ink deposited on the sheets S, with the sheets typically undergoing the drying and fixing process within a single rotation of the drum member 21.

Figure 5:
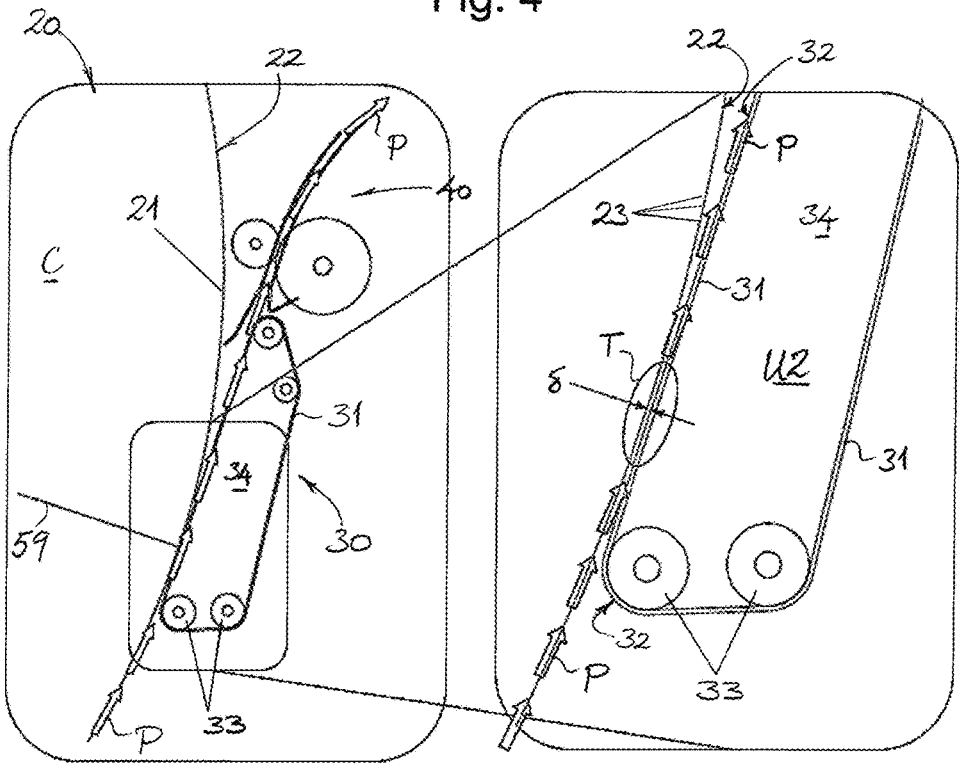
FIG. 5 is a detailed partial schematic side view of a transfer system in the print medium transport mechanism of FIG. 4.

Referring also now to FIG. 5 of the drawings, the transport mechanism 2 further includes a transfer system 50 comprising a second conveyor device 30 having a movable second conveyor body 31 provided in the form of a belt member. The belt member 31 is of a flexible material and has an outer surface 32 for supporting and holding the plurality of sheets S; i.e. forming a second carrier surface 32 of the second conveyor device 30. The belt member 31 is mounted on tensioning drive rollers 33, which maintain the belt member 31 taut and drive the belt member 31 in circulation such that the second carrier surface 32 travels at substantially the same instantaneous speed as the first carrier surface 22 of the drum member 21. As is apparent from FIGS. 4 and 5, the transfer system 50 is arranged so that the second conveyor device 30, and particularly the second conveyor body or belt member 31 is located directly adjacent to or next to the drum member 21 of the first conveyor device 20. The transfer system 50 of the transport mechanism 2 is particularly designed or configured for transferring the sheets S of the print medium from the first conveyor device 20 to the second conveyor device 30; and more specifically, from the drum member 21 to the belt member 31. This transfer of the print medium sheets S occurs in a transfer region T which is particularly apparent from FIG. 5 of the drawing. In particular, this transfer region T is located where an instantaneous velocity of both (i) the first carrier surface 22 on the outer periphery of the drum member 21, and (ii) the second carrier surface 32 on the outer surface of the belt member 31, are substantially the same in both magnitude and direction. Thus, the arrows representing the transport path P of the sheets S can be seen to make a transition in this transfer region T from following the outer surface 22 of the drum member 21 to following the outer surface 32 of the belt member 31.

Figure 6:
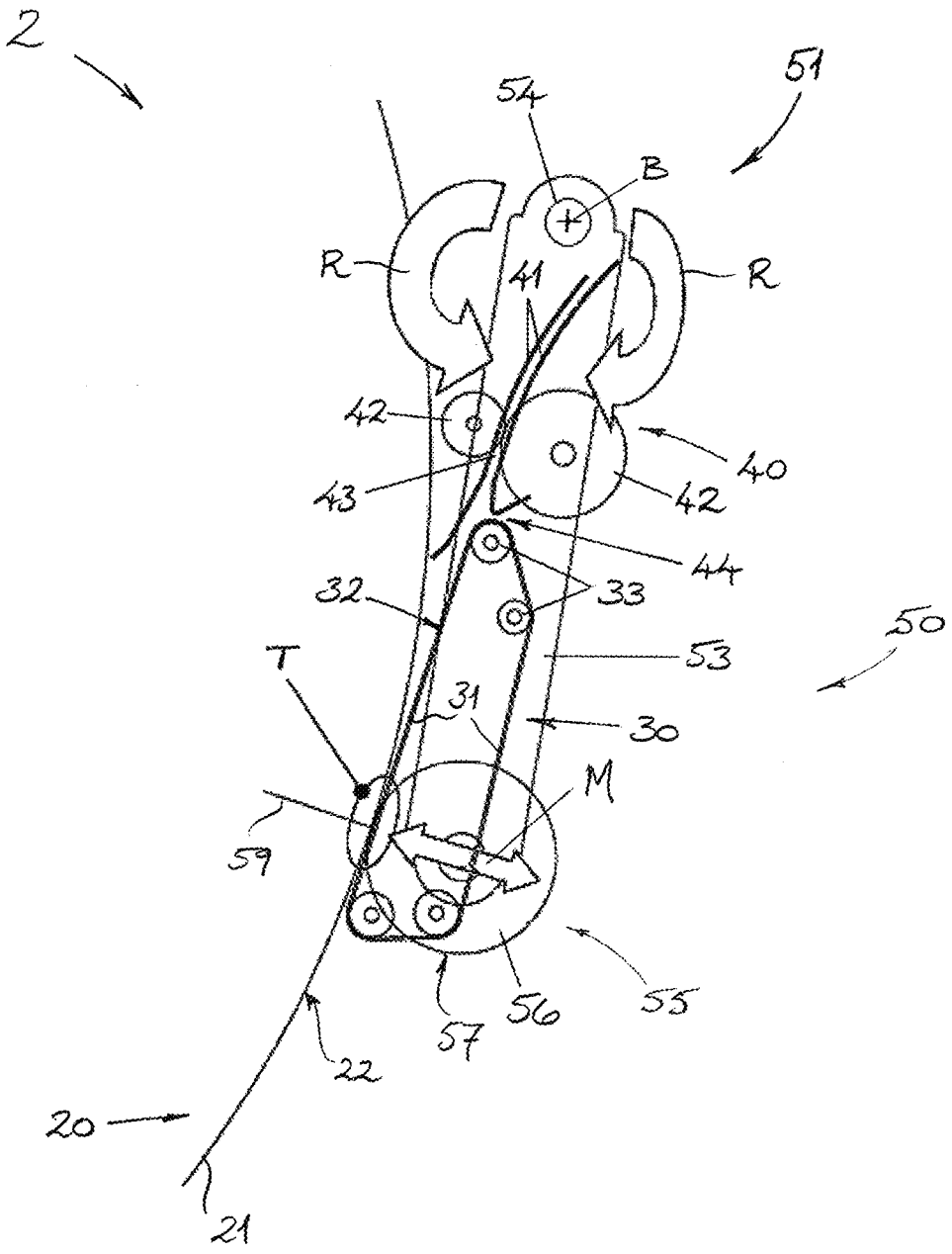
FIG. 6 is a more detailed schematic side view of the transfer system in the print medium transport mechanism of FIG. 4 and FIG. 5.
Figure 7:
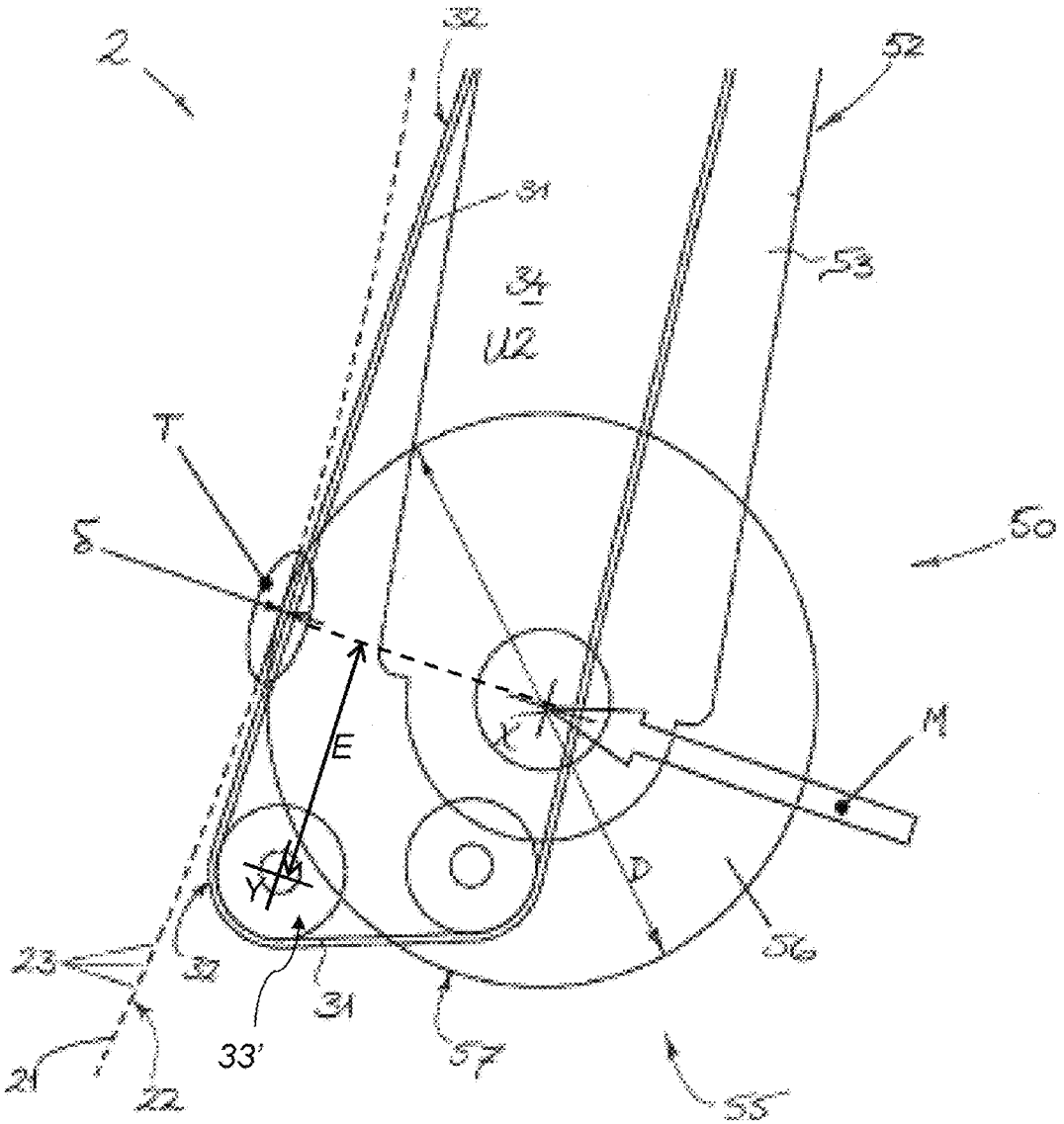
FIG. 7 is a detailed partial schematic side view of the transfer system in the sheet transport mechanism of FIG. 6.
Figure 8:
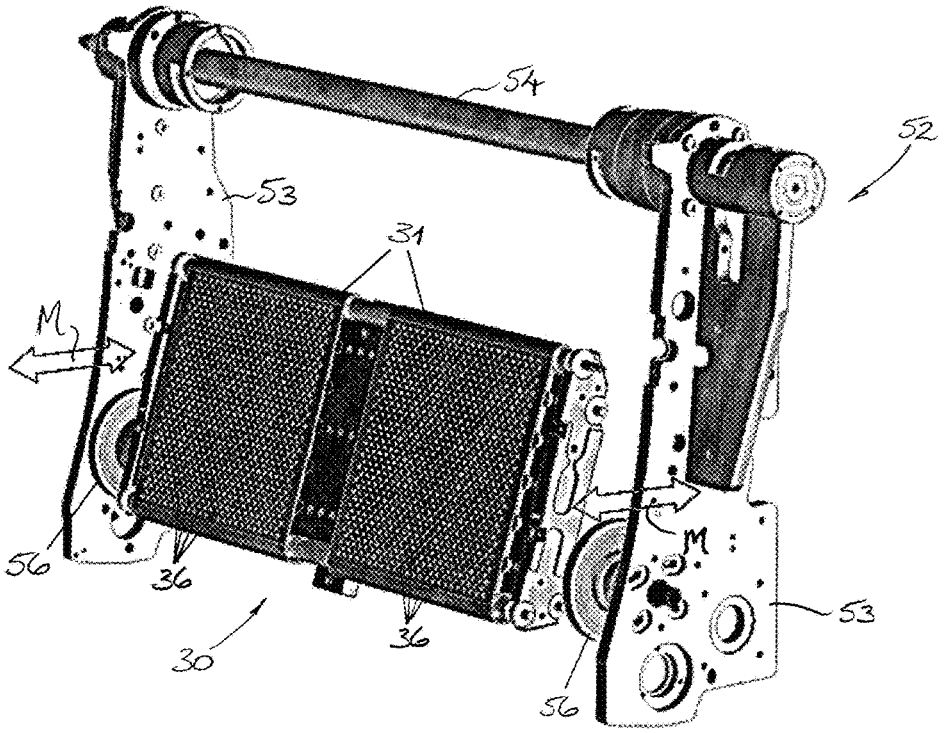
FIG. 8 is a perspective view of a transfer system in the transport mechanism according to a preferred embodiment of the invention.

With reference now to FIGS. 6, 7 and 8 of the drawings, the transport mechanism 2 according to a preferred embodiment is illustrated in more detail, with particular attention to the transfer system 50. In this regard, the transfer system 50 includes a transfer unit 51 which incorporates the second conveyor device 30. The transfer unit 51 has a support frame 52 comprising a pair of generally parallel and spaced apart frame members 53 which are pivotally mounted on a fixed pivot shaft 54 for pivoting movement (i.e. in a plane of FIG. 6) about a pivot axis B which extends substantially parallel to the central axis A of the drum member 21. These frame members 53 can pivot about the axis B independently of one another. The second conveyor device 30 is mounted on the support frame 52 of the transfer unit 51 between the generally parallel and spaced apart frame members 53. Thus, any pivoting of the support frame 52 on the pivot shaft 54 about the pivot axis B can generate rotation in either of the directions designated by the arrows R in FIG. 6. Such pivoting movement of the support frame 52 causes the transfer unit 51, and particularly the belt member 31 of the second conveyor device 30 mounted on the support frame 52, to move in a direction represented by double-headed arrow M. As the first conveyor body or drum member 21 is rotatably mounted to a stationary base frame (not shown) of the printing system 1 and the transfer unit 51 is pivotally mounted to the same stationary base frame via the pivot shaft 54, it will be noted that the transfer unit 51 is movable relative to the axis A of the drum member 21. This is useful for maintaining a constant or predefined spacing δ between the belt member 31 and the drum member 21 during operation of the transport mechanism 2, as will be explained below.

Drawing FIG. 7 shows the transfer region T and the predefined spacing δ between the first carrier surface 22 on the outer periphery of the drum member 21 and the second carrier surface 32 on the outside of the belt member 31 in greater detail. In this regard, the transfer system 50 includes spacer means 55 which is configured to maintain the precisely predefined spacing δ between the first and second conveyor bodies 21, 31 (i.e. drum member and belt member), especially between the first and second carrier surfaces 22, 32. In particular, the spacer means 55 comprises a pair of spacer rollers or spacer wheels 56, each of which is rotatably mounted about a central axis X at an end region of a respective frame member 53 opposite the end region connected to the pivot shaft 54. Each spacer roller or spacer wheel 56 is circular and manufactured to a very high tolerance such that it has a predetermined precise diameter D with a circular outer periphery 57. This outer periphery 57 of each wheel 56 is configured to contact and engage the outer surface 22 (i.e. the first carrier surface) of the drum member 21. Furthermore, the spacer means 55 of the transfer unit 51 comprises biasing means (not shown) for resiliently biasing each spacer roller or wheel 56 into engagement with the outer surface 22 of the drum member 21 in the direction of arrow M. For example, the transfer unit 51 may include spring means, such as one or more torsion springs, acting between the pivot shaft 54 and each of the frame members 53 of the support frame 52 to resiliently bias the frame members 53 into rotation about the pivot axis B such that the periphery 57 of each spacer wheel 56 is forced into contact with and bears against the outer surface 22 of the drum member 21. Furthermore, the diameter D of the spacer roller or wheel 56 is selected such that the periphery 57 of the spacer wheel projects beyond the outer surface 32 of the belt member 31 by a distance corresponding to the predefined spacing δ. In this way, when the outer periphery 57 of the spacer wheel 56 makes contact with the outer surface 22 of the drum member 21 for rolling engagement therewith, the outer surface 32 of the belt member 31 is directly adjacent to, but spaced from the drum surface 22 by this predefined spacing or gap δ in the transfer region T, as illustrated in FIG. 7.

Each spacer roller or spacer wheel 56 is desirably arranged and mounted on the support frame 52 of the transfer unit 51 so that its point of contact with the carrier surface 22 of the drum member 21 is in the transfer region T, especially at a point where the belt member 31 of the second conveyor device 30 extends generally tangentially to the drum member 21. By virtue of the resilient spring bias and the potential for pivoting movement of the support frame 52 in the directions M, as well as the arrangement and precise diameter D of the spacer wheel 56, the predefined spacing or gap δ between the outer surface 22 of the drum member 21 and the outer surface 32 of the belt member 31 in the transfer region T is able to be held constant at each frame member 53 independently, irrespective of manufacturing tolerances or run-out of the drum member 21 and irrespective of any expansion or contraction in the drum member 21 caused by temperature change. In this regard, it will be noted that the drum conveyor device 20 in the fixing and drying unit 11 is heated and that, particularly during a start-up phase of operation of the printing system 1, the drum member 21 may experience temperature changes of several degrees causing slight changes in the drum diameter. As the predefined spacing or gap δ is to be held relatively small, e.g. about 1 mm, it is particularly susceptible to dimensional variation of the components of the transport mechanism 2 due to manufacturing tolerances and/or due to thermal expansion or contraction. The spacer wheels 56 of the spacer means 55 eliminate any significant deviations from the spacing or gap δ between the first and second conveyor bodies 21, 31.

Furthermore, the belt member 31 is deflected by a first deflection roller 33' about its deflection axis Y at the entrance of the transfer region T upstream of the transfer region T in the medium transport direction. The deflection axis Y of the first deflection roller 33' is positioned upstream at a predetermined distance E with respect to the axis X of the spacer roller 56 along the transport path.

In this way, the contact point of the spacer roller 56 to the drum member 21 is arranged downstream of the deflection axis Y. As such, a part of the belt member 31, which is disposed between the first deflection roller 33' and the predefined spacing δ at the contact point of the spacer roller 56 to the drum member 21, is arranged for guiding the sheets along the transport path towards the predefined gap δ.

Figure 9:
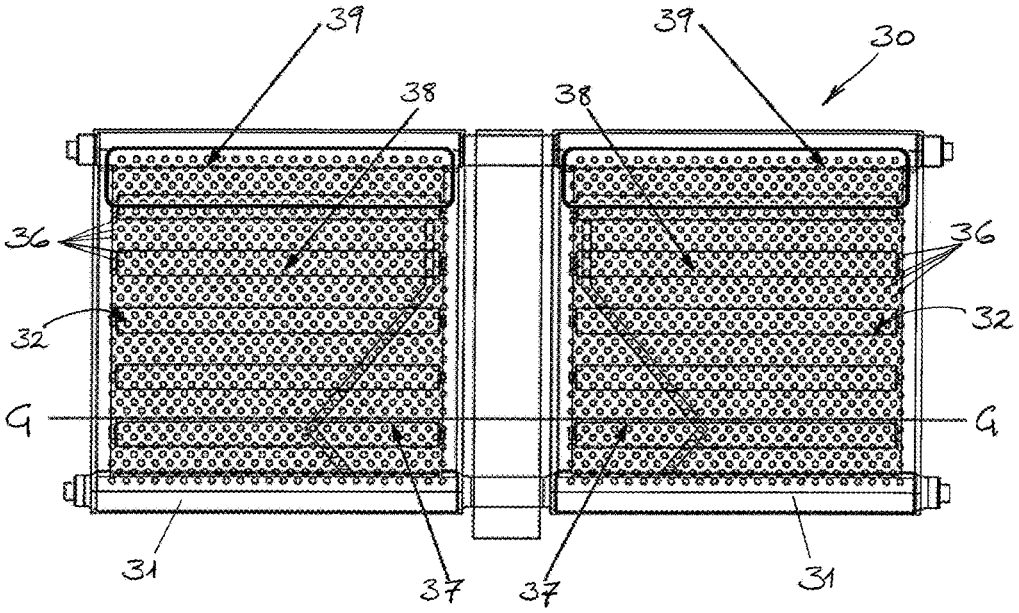
FIG. 9 is a front view of the second conveyor device in the transfer system of the transport mechanism according to a preferred embodiment.
Figure 10:
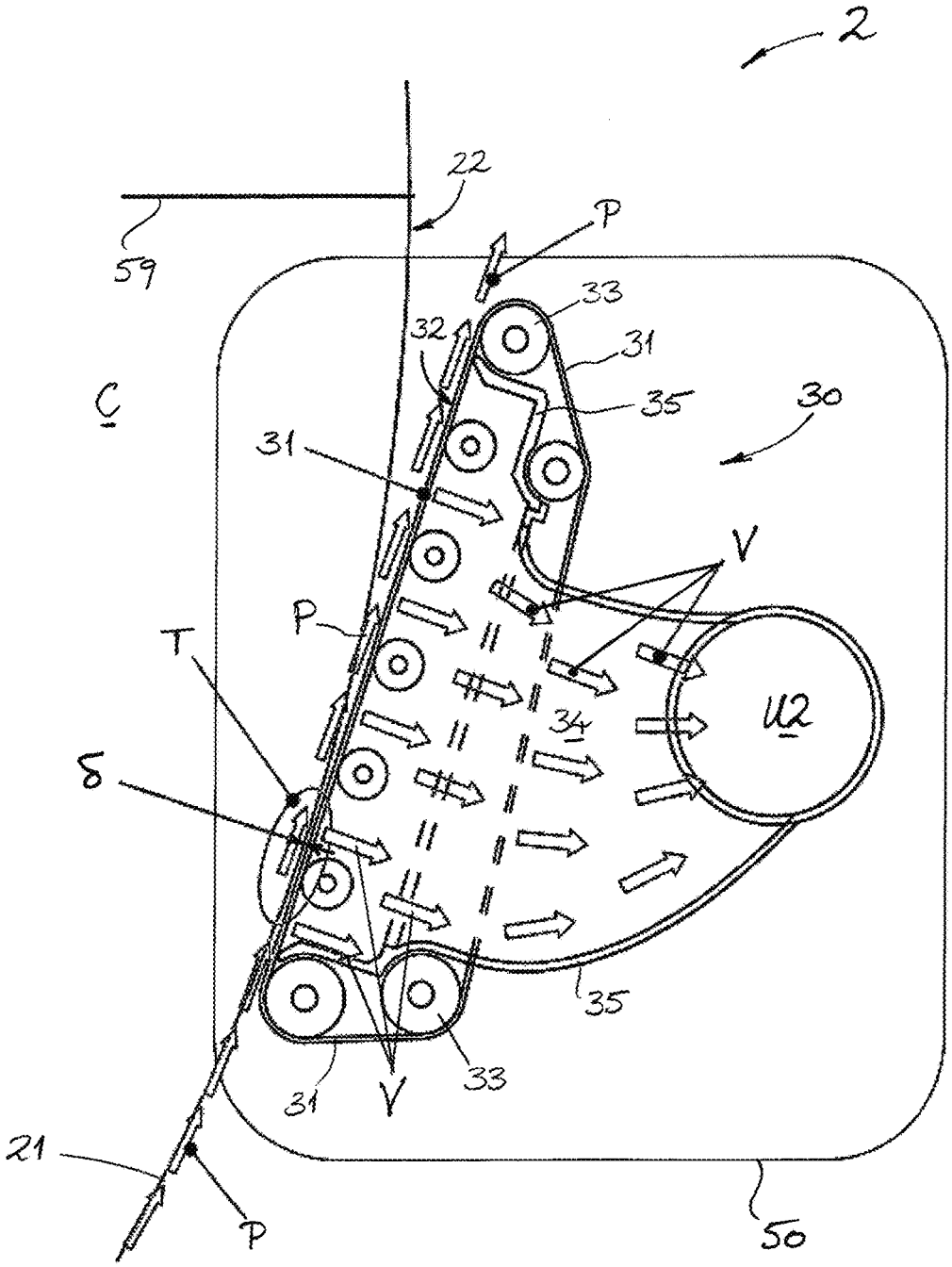
FIG. 10 is a detailed side view of the second conveyor device in the transfer system of the transport mechanism according to this embodiment.

With reference to FIGS. 8 to 10 of the drawings, the manner in which the sheets S of print medium are actually transferred by the transfer system 50 from the rotating drum member 21 of the first conveyor device 20 to the moving belt member 31 of the second conveyor device 30 will now be described in more detail. The second conveyor device 30 also includes suction means, typically provided by fan means such as a centrifugal or axial fan, which generates a second under-pressure U2 within a space or cavity 34 enclosed or at least partially surrounded by the second conveyor body 31, i.e. the conveyor belt member. This is apparent from FIG. 10, which illustrates a cavity or chamber 34 enclosed by walls 35 arranged within the endless belt member 31 in which the second under-pressure U2 is provided. As can be seen in FIGS. 8 and 9 of the drawings, the belt member 31 of the second conveyor device 30 includes with an array of holes or apertures 36 which provide fluid communication through the belt member 31 into the cavity or chamber 34 in which the second under-pressure U2 is provided. As a result, air is drawn through the belt member 31 under the influence of the under-pressure U2 in the direction of the arrows V in FIG. 10 directed perpendicular to the outer surface 32 of the belt member 31. The arrows in FIG. 10 directed parallel to the carrier surface 32 of the belt member 31, on the other hand, designate the transport path P of the sheets S through the transport mechanism 2. The second under-pressure U2, and the airflow it generates through the holes or apertures 36 into the belt member 31 acts to attract and to draw the sheets S from the first conveyor device 20 to the second conveyor device 30.

Before the sheets S of print medium travelling along the transport path P on the carrier surface 22 of the drum member 21 are transferred to the belt member 31 of the second conveyor device 30, however, the transfer system 50 is configured to reduce or eliminate the first under-pressure U1 acting in the transfer region T, as this would otherwise act to inhibit the sheets S moving to the second conveyor device 30 under influence of the second under-pressure U2. In this embodiment, the transfer system 50 comprises shielding means 58 for shielding the transfer region T of the first conveyor body or drum member 21 from the action of the first suction means and thus from the under-pressure U1. This shielding effect may be achieved by one or more wall member or baffle member 59 arranged to shield or to shutter a portion or segment of the internal cavity 24 of the drum member 21 from the influence or effect of the first suction means and first under-pressure U1. In particular, the one or more wall member or baffle member 59 of the shielding means 58 may define a transfer cavity C within the first conveyor body 21 in the transfer region T. Such an arrangement of wall members or baffle members 59 is illustrated schematically in FIG. 4 by defining a segment C of the internal cavity 24 of the drum member 21 which is excluded from the influence of the under-pressure U1 generated by the suction means. Indeed, this segment C may optionally be subjected to an over-pressure O such that a sheet S of print medium entering this region T may not only be physically released from the first carrier surface 22 of the drum member 21 by the reduction or elimination of the under-pressure U1, but may also receive an impulse away from the carrier surface of the drum member 21 towards the directly adjacent belt member 31 of the second conveyor device 30. In this way, the second under-pressure U2 acting within the second conveyor device 30 attracts a leading edge region of a sheet S of print medium entering the transfer region T on the drum member 21 as this leading edge region is released from its attachment to the drum member 21. As the predefined spacing δ between the drum member 21 and the belt member 31 is maintained constant and small (e.g. 1 mm), the leading edge region of the sheet S can be immediately drawn across the spacing or separation gap δ onto the belt member 31 under the influence of the airflow being drawn through the holes or apertures 36 in the belt member under the influence of the second under-pressure U2.

With particular reference to FIG. 9 of the drawings, it will be noted that the suction force or attractive force acting over the second conveyor body or belt member 31 may be non-uniform. In particular, the belt member 31 desirably has a region 37 at the second carrier surface 32 in which the suction force or airflow is relatively high. This region 37 is configured in a double-triangular or 'diamond' shape and is at its widest along an axis G corresponding to the line of the predefined spacing or gap δ between the first and second conveyor bodies 21, 31. By arranging the region 37 of high airflow centrally of the belt member 31, the sheets S entering the transfer region T of the transfer system 50 are attracted or drawn towards the belt member 31 predominantly in a centre portion of the sheet S. Thus, a centre portion of the sheet S is drawn firstly onto the surface 32 of the belt member 31, with the lateral sides of the sheet S following. Surrounding the central region 37 of high air-flow in the second conveyor body 31 is a region 38 of relatively low air-flow into the holes or apertures 36 of the belt member 31. This promotes a gentle and even flattening of the sides of the sheet S onto the second conveyor device 30 without wrinkles.

As can be seen from FIGS. 8 and 9, the contact point of the spacer roller 56 to the drum member 21, as indicated by the line of axis G, is arranged and positioned downstream of the first deflection roller 33'. As such, a part of the belt member 31, which is disposed between the first deflection roller 33' and the predefined spacing δ at the contact point G of the spacer roller 56 to the drum member 21, is arranged for guiding the sheets along the transport path towards the predefined gap δ.

As can be seen from FIGS. 9 and 10, in the part of the belt member 31 disposed between the deflection roller 33' and the axis G the sheets are already attracted towards the belt member 31 by regions 37 and 38 as indicated by arrows V.

As can be seen in FIG. 6 of the drawings, the transfer unit 51 of this embodiment includes a third conveyor device 40 downstream of the second conveyor device 30 for conveying the sheets S of print medium further along the transport path P. This third conveyor device 40 comprises sheet guide members 41 which together form a further portion of the transport path P and a plurality of feed rollers 42 which engage and further convey the sheets S of print medium along the transport path. The feed rollers 42 form a nip or 'pinch' 43 through which the sheets S are drawn. With reference to both FIG. 6 and FIG. 9, a region 39 of the belt member 31 which is located adjacent to an inlet 44 of the third conveyor device 40 has moderate or medium level of air-flow into the holes or apertures 36 of the belt member 31 in order to ensure the sheets S travelling on the second conveyor device 30 are fully flattened before they leave the belt and enter third conveyor device 40. The tight curve traveled by the belt member 31 around the drive roller 33 in this region 39 serves or assists to separate the belt member 31 from the sheet S at the inlet 44 to the third conveyor device 40, despite the action of the medium level air-flow. A leading edge of the sheet guide members 41 at the inlet 44 also assists to feed the sheets S correctly into the third conveyor device 40.

Figure 11:
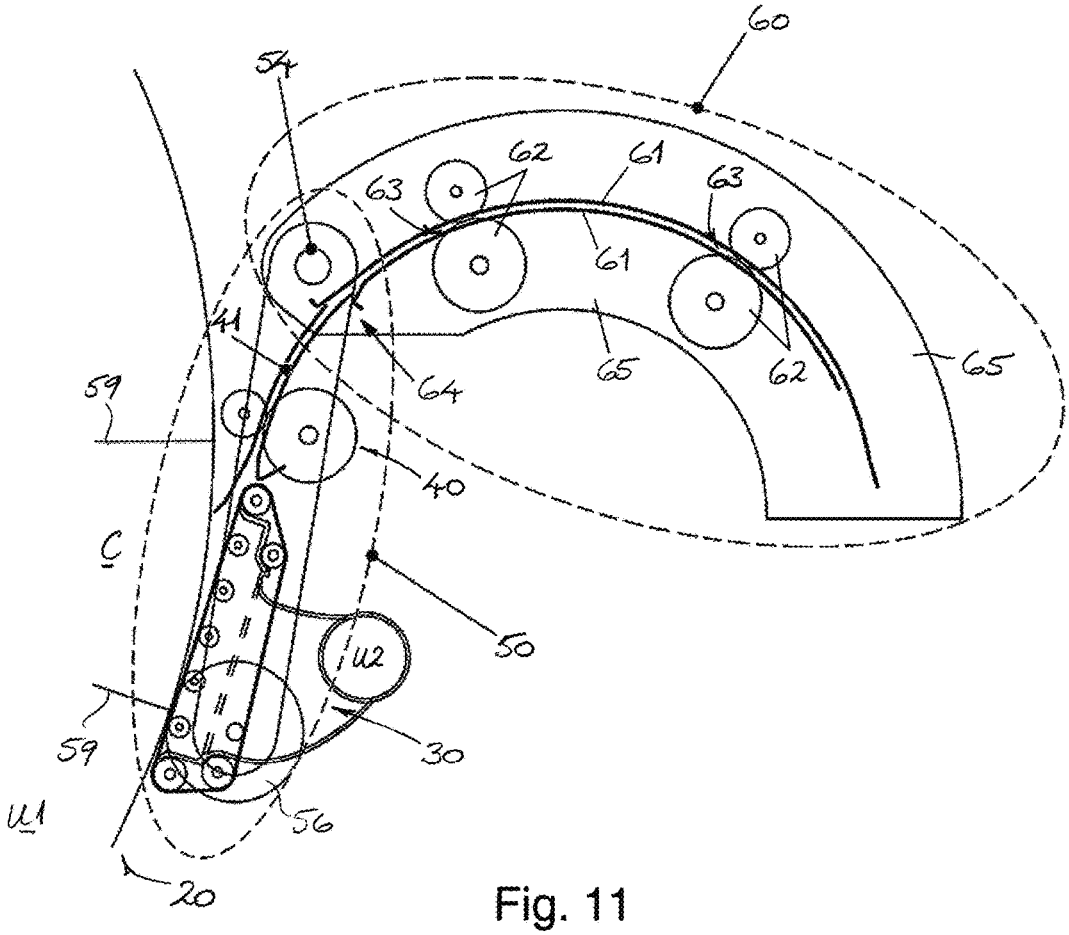
FIG. 11 is a detailed side view of the transport mechanism according to the preferred embodiment.

Referring now to FIG. 11 of the drawings, a preferred embodiment of the transport mechanism 2 is shown which essentially comprises all of the features described above, but which also includes a further (fourth) conveyor device 60 for conveying the sheets S of the print medium further along the transport path downstream of the transfer unit 51. Similar to the third conveyor device 40, the fourth conveyor device 60 comprises sheet guide members 61 which define a further portion of the transport path P and a plurality of feed rollers 62 which engage and further convey the sheets S along that portion of the transport path P. These feed rollers 62 again form at least one nip or 'pinch' 63 through which the sheets S are drawn or fed in the conveyor device 60. An inlet 64 to the fourth conveyor device 60 is arranged immediately downstream of the third conveyor device 40, in such a manner that the sheet guide members 41 of the third conveyor device 40 feed the sheets S directly into that inlet 64. As can be seen in FIG. 11, the fourth conveyor device 60 is supported on frame 65 which is mounted on the pivot shaft 54. This has the advantage that the inlet 64 to the fourth conveyor device 60 is located very close to the pivot axis B. This configuration is advantageous because, while the transfer unit 51 may undergo movement about the pivot axis B as the spacer wheels 56 follow variations in the diameter of the drum member 21, e.g. due to tolerances or run-out or thermal effects, to maintain a constant spacing or gap δ, the proximity to the pivot axis B of the transition from the third conveyor device 40 to the inlet 64 of the fourth conveyor device 60 means that very little movement occurs in this area. In other words, the transport path P of the sheets S in this area is substantially not influenced by any movement of the transfer unit 51.

Figure 12:
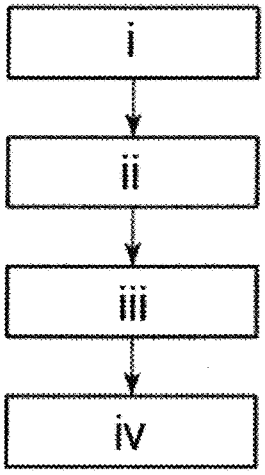
FIG. 12 is a flow chart showing an embodiment of a method of transporting a print medium according to the invention.

Finally, with reference now to FIG. 12 of the drawings, a flow diagram is shown that schematically illustrates steps in a method of transporting sheets S, e.g. of a print medium, according to a preferred embodiment of the invention described above with respect to FIGS. 4 to 11. In this regard, the first box i of FIG. 12 represents the step of holding a plurality of sheets S of print medium on a first conveyor body 21, such as a drum member, in a first conveyor device 20, by means of a first suction or first under-pressure U1 and moving the first conveyor body 21 (e.g. rotating the drum member) to convey the sheets S along a transport path P. The first under-pressure U1 may be generated within the drum by one or more fan and the outer surface 22 of the drum member 21 includes an array of holes 23 communicating with an interior cavity 24 of the drum, so that the under-pressure U1 generated within the drum acts via the holes 23 to hold the sheets S fixed in position supported on the carrier surface. The second box ii represents a step of providing a second conveyor device 30 having a second conveyor body 31 for holding the sheets S and which is movable to convey the sheets S further along the transport path P. The third box iii then represents the step of releasing the sheets S of print medium from the moving first conveyor body 21 of the first conveyor device 20 in a transfer region T. This preferably comprises reducing, excluding or eliminating the first under-pressure U1 provided at the carrier surface 22 of the drum member 21 in the transfer region T. The final box iv in FIG. 12 represents the step of attracting the sheets S to the moving second conveyor body 31 of the second conveyor device 20 in the transfer region T to convey the sheets S further along the transport path P. To this end, the second conveyor device 30 may include suction means for providing a second under-pressure U2 in the second conveyor body 31 which pulls or draws the sheets S from the first conveyor device 20 to the second conveyor device 30 in the transfer region T.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF REFERENCE SIGNS

1 printing system
2 transport mechanism
3 conveyor belt
4 first pre-treatment module
5 pre-treatment liquid applicator device
6 storage tank
7 roller
7' roller
8 dryer device
9 image forming device or inkjet marking module
90 inkjet nozzle
91 inkjet marking device
92 inkjet marking device
93 inkjet marking device
94 inkjet marking device
101 inkjet head
102 inkjet head
103 inkjet head
104 inkjet head
105 inkjet head
106 inkjet head
107 inkjet head
10 temperature control device
11 drying and fixing unit
20 first conveyor device
21 first conveyor body or drum member
22 first carrier surface
23 hole or aperture
24 cavity of drum member
30 second conveyor device
31 second conveyor body or belt member
32 second carrier surface
33 drive roller
34 cavity or chamber
35 wall
36 hole or aperture
37 high air-flow region
38 low air-flow region
39 moderate air-flow region
40 third conveyor device
41 sheet guide member
42 feed roller
43 nip or pinch between feed rollers
44 inlet
50 transfer system
51 transfer unit
52 support frame
53 frame member
54 pivot shaft
55 spacer means
56 spacer roller or spacer wheel
57 periphery of spacer wheel
58 shielding means
59 wall member or baffle member
60 fourth conveyor device
61 sheet guide member
62 feed roller
63 nip or pinch between feed rollers
64 inlet
65 frame
d nozzle pitch
S sheet of print medium
P transport path
T transfer region
A central axis of first conveyor body or drum
B pivot axis of pivot shaft
R pivot directions of pivot shaft
M movement direction of transfer unit in transfer region
δ predefined spacing or gap X rotational axis of spacer roller or spacer wheel
Y deflection axis of first deflection roller
D diameter of spacer roller or spacer wheel
E predetermined distance between axis of spacer roller and deflection axis
U1 first under-pressure
U2 second under-pressure
C transfer cavity
O over-pressure
G spacing or gap axis

The invention claimed is:

1. A transport mechanism for transporting sheets of a print medium along a transport path in a printing system, comprising:

a first conveyor device having a first conveyor body which is configured to hold a plurality of sheets of print medium and is movable to convey the sheets along the transport path; and a transfer system comprising a second conveyor device having a second conveyor body which is configured to hold the sheets and is movable to convey the sheets further along the transport path, wherein the transfer system is configured to transfer the sheets from the first conveyor body to the second conveyor body in a transfer region, wherein the second conveyor body is arranged adjacent the first conveyor body in the transfer region, and the transfer system is configured to provide a second under-pressure at the second conveyor body arranged for contactless transfer of the sheets from the first conveyor body to the second conveyor body, wherein the second conveyor body has a second carrier surface configured to support the sheets thereon, and wherein the second conveyor device provides regions on the second carrier surface of different air-flow from the second under-pressure, the second carrier surface including a region of relatively higher suction force or air-flow arranged in a central region of the second carrier surface with respect to the transport path arranged for attracting a centre portion of the each sheet with respect to the transport path towards the second conveyor body in the transfer region.

2. A transport mechanism according to claim 1, wherein said regions on the second carrier surface further include a region of relatively low air-flow for attracting lateral side portions of each sheet, said region of relatively low air-flow surrounding said central region of relatively higher suction force or air-flow in a direction lateral to the transport path.

3. A transport mechanism according to claim 1, wherein the second under-pressure at the second conveyor body overcomes a holding force on the sheets of print medium on the first conveyor body.

4. A transport mechanism according to claim 1, wherein the transfer system is configured to release a holding force on the sheets of print medium on the first conveyor body at the transfer region.

5. A transport mechanism according to claim 4, wherein the first conveyor device is configured to provide a first under-pressure at the first conveyor body to hold the sheets fixed in position on the first conveyor body as it conveys the plurality of sheets along the transport path, and wherein the transfer system is configured to reduce or exclude the first under-pressure in the transfer region.

6. A transport mechanism according to claim 5, wherein the transfer system includes a shield configured to shield a section of the first conveyor body from the first under-pressure.

7. A transport mechanism according to claim 6, wherein the shield comprises one or more baffle members arranged within the first conveyor body, such that the one or more baffle members shield or shutter a section of the first conveyor body in the transfer region.

8. A transport mechanism according to claim 1, wherein the first conveyor body is provided as a drum member and an outer periphery or circumference of the drum member forms a first carrier surface for supporting the plurality of sheets thereon, wherein the first conveyor body is configured to provide a first under-pressure within the drum member, and wherein the drum member is rotatable about an axis to convey the sheets along the transport path.

9. A transport mechanism according to claim 8, wherein the first carrier surface includes holes or apertures which communicate the first under-pressure and which are at least partially covered by the plurality of sheets of print medium held fixed in position on the first carrier surface.

10. A transport mechanism according to claim 1, wherein the transfer system provides the second under-pressure at the second conveyor body to hold the sheets fixed in position thereon as the second conveyor body conveys the sheets further along the transport path.

11. A transport mechanism according to claim 10, wherein the second carrier surface includes holes or apertures to communicate the second under-pressure provided by the transfer system to hold the sheets on the second conveyor body as it conveys the sheets further along the transport path.

12. A printing system comprising a transport mechanism according to claim 1.

13. A transport mechanism according to claim 1, wherein the transfer system comprises a centrifugal fan or an axial fan.

14. A method of transporting sheets of print medium in a printing system, comprising:

holding a plurality of sheets of a print medium on a first conveyor body in a first conveyor device and rotating the first conveyor body to convey the sheets along a transport path;

providing a second conveyor device having a second conveyor body for holding the sheets;

releasing the sheets of print medium from the first conveyor body in a transfer region; and attracting the sheets to the second conveyor body of the second conveyor device in the transfer region to contactless transfer the sheets from the first conveyor body to the second conveyor body and Moving the second conveyor body to convey the sheets further along the transport path, wherein the second conveyor body has a second carrier surface configured to support the sheets thereon, wherein the step of attracting the sheets to the second conveyor body comprises providing a second suction force or second under-pressure in or at the second conveyor body, wherein the second conveyor device provides regions of different air-flow from the second under-pressure over the second carrier surface, and wherein in a central region of the second carrier surface with respect to the transport path the sheet is attracted by a relatively higher suction force or air-flow to attract a centre portion of the sheet with respect to the transport path towards the second conveyor body.

15. A method according to claim 14, wherein the step of holding the plurality of sheets on the first conveyor body includes providing a first suction force or first under-pressure to hold the sheets fixed in position on the first conveyor body as it moves to convey the sheets along a transport path; and wherein the step of releasing the sheets of print medium from the first conveyor body comprises reducing, excluding or eliminating the first under-pressure in the transfer region.

16. A method according to claim 14, wherein the step of attracting the sheets to the second conveyor body further comprises providing the second suction force or second under-pressure in or at the second conveyor body to hold the sheets fixed in position on the second carrier surface of the second conveyor body as it moves to convey the sheets further along the transport path.

* * * * *